350-96.15 SR
XR 3,967,123
TX30641

United State
Deylius et al.

[11] 3,967,123
[45] June 29, 1976

[54] COUPLING TWO OPTICAL WINDOWS

[75] Inventors: Hendrik Gerardus Deylius; Jan Frederik Lammers; Antonius Paulus Notenboom, all of Eindhoven, Netherlands

[73] Assignee: U.S. Philips Corporation, New York, N.Y.

[22] Filed: June 28, 1974

[21] Appl. No.: 484,077

[30] Foreign Application Priority Data

July 5, 1973 Netherlands ..... 7309383

[52] U.S. Cl. ..... 250/368; 250/213 VT
[51] Int. Cl.[2] ..... H01J 31/50
[58] Field of Search ..... 250/361, 362, 368, 213 VT

[56] References Cited

UNITED STATES PATENTS 3,058,021 10/1962 Dunn ..... 250/213 VT X
3,591,808 7/1971 Prag et al. ..... 250/368
3,676,671 7/1972 Sheldon ..... 250/368

*Primary Examiner*—Archie R. Borchelt
*Attorney, Agent, or Firm*—Frank R. Trifari; Leon Nigohosian

[57] ABSTRACT

For coupling optical windows, in particular two fiber-optics windows, a diaphragm construction is used. This ensures a homogeneous pressure distribution over the window areas and prevents sliding or tilting movements of the windows. By reducing the weight of the components to be supported by the coupling to a minimum the elastic pressure to be exerted by the diaphragm construction can be restricted.

9 Claims, 3 Drawing Figures

3967123
CR IN 250/368

COUPLING TWO OPTICAL WINDOWS

The invention relates to an image sensing system in which an optical window of an image-forming apparatus is coupled with an optical window or a sensing apparatus.

In known image recording systems image transfer frequently is subject to disturbances owing to the fact that the two windows do not engage one another with optimum contact under all conditions. This is mainly due to the fact that relative movement and in particular sliding and tilting movements of the windows are not sufficiently prevented. Furthermore uniform pressure over the surfaces of contact of the windows is not sufficiently ensured. As a result, not only can satisfactory image transfer be disturbed, but also the likelihood of permanent damage of the windows, in particular owing to sliding, is great.

It is an object of the present invention to provide an sensing, or image recording, system in which the said disadvantages are eliminated or at least greatly reduced. For this purpose an image sensing system of the abovedescribed type according to the invention is characterized in that the optical window of the sensing apparatus is coupled under elastic pressure with the optical window of the image-forming apparatus by means of a diaphragm construction.

An elastic diaphragm may readily be given mechanical properties such that whilst retaining a sufficient amount of freedom with respect to actual displacement both tilting movement due to buckling of the diaphragm and sliding movement due to radial motion in the diaphragm are considerably restricted. In a preferred embodiment the diaphragm construction is mainly rotation-symmetrical and is formed with a central aperture adapted to receive a support rigidly secured to one window to be coupled. The outer edge of the diaphragm can be coupled with a support for the second window. Owing to the elastic pressure which is applied around the windows homogeneous distribution of the pressure over the entire contact surface is ensured.

Figure 1:
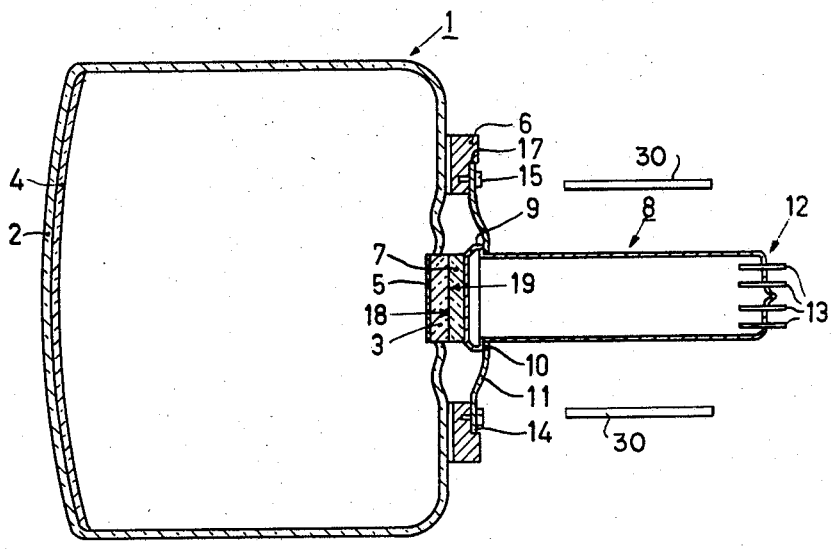
Figure 2:
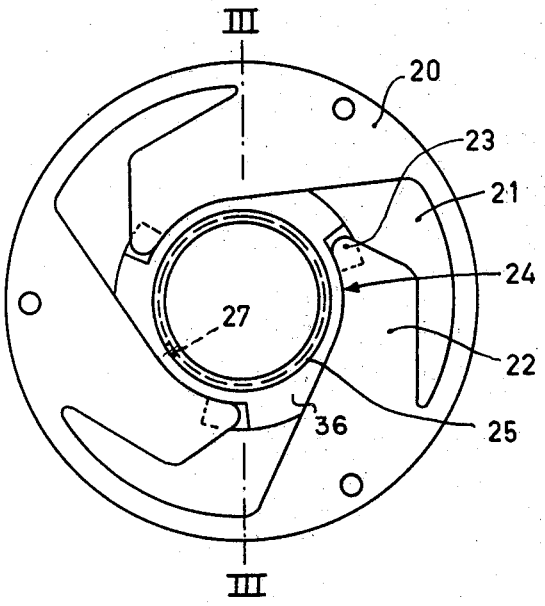
Figure 3:
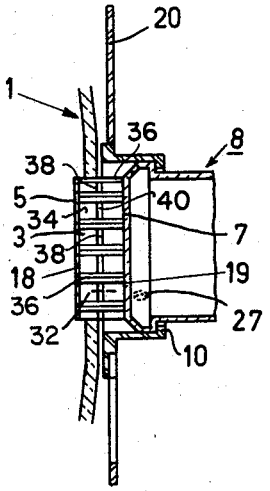

Embodiments of the invention will now be described, by way of example, with reference to the accompanying diagrammatic drawings, in which:

FIG. 1 shows schematically an image intensifier tube provided with a fibre-optics window which by a diaphragm construction according to the invention is coupled with a television camera tube also provided with a fibre-optics window, and FIGS. 2 and 3 are radial and axial sectional views respectively of a preferred embodiment of a diaphragm construction according to the invention.

In a preferred embodiment according to the invention shown in FIG. 1 the following components of a known image intensifier tube 1 are shown: An entrance window 2 and an exit window 3 which in this embodiment comprises a fibre-optics plate of diameter 28 mm and thickness 5 mm. The entrance window is internally coated with an X-ray photocathode 4 comprising in succession, but not shown separately, an X-ray fluorescent layer made for example of caesium iodide, a separating layer of aluminium oxide, and a photocathode layer from which captured X-rays cause photoelectrons to be emitted. The exit window is internally coated with a luminescent layer 5 in which the photoelectrons, after being accelerated by an electrode system, not shown, produce an optically perceivable image. The image intensifier tube is provided on its exit surface with mechanical prefocussing means which determine a reference face for the exit window and comprise for example a ring 6 secured to the tube. The ring 6 may be replaced by a few, for example three, projections. The ring or the projections may be secured to the enclosure of the image intensifier tube by means of a resin or an enamel. An entrance window 7 of a camera tube 8 is coupled with the exit window 3 of the image intensifier tube. The camera tube is of a known type, such as for example a vidicon or plumbicon, and hence need not described in more detail. The camera tube at its window end is formed with a protruding rim 9 having an annular face 10. The face 10 acts as a support for a diaphragm 11 which in the embodiment shown can be slipped on to the camera tube 8 from the base end 12 provided with lead-in pins 13. Thus, only the comparatively light-weight and small-size camera tube itself is involved in the coupling operation, the bulky coil unit 30 being subsequently mounted so as to surround the tube without bearing on it. An outer edge 14 of the diaphragm 11 is secured to the ring 6, for example by screws 15. Both during coupling and in operation any relative sliding movement of the window faces 18 and 19 must be avoided. For this purpose the ring 6 has a transversal orienting or reference face 17. In the embodiment shown the diaphragm may be in the form of a flat ring made of a metal or a synthetic material, the latter having the advantage of reducing the input capacitance for the camera tube, which improves the signal noise ratio in the image signal to be detected. The pressure exerted on the window faces 18 and 19 in the coupled condition is determined by the material properties and the geometry of the diaphragm in this condition.

The possibility of the windows sliding on one another is substantially avoided in this construction whilst the possibility of tilting may readily be restricted by the rigidity of the diaphragm material and by the pressure exerted, because the coil unit need not be supported by the coupling construction.

FIGS. 2 and 3 show a preferred embodiment of a diaphragm construction according to the invention in which the diaphragm lies in a plane in the coupled condition. The elastic pressure then is determined by the degree of pre-deformation and by the choice of the material of the diaphragm. In order to extend the distance of deflection and to reduce the amount of material with a view to the abovementioned input capacitance of the camera tube, a disk 20 of a synthetic material or a metal is formed with spiral incisions 21. Resulting lugs 22 have tips 23 and edges 24 which enable an inner ring 25, which is also made of a metal or a synthetic resin, to be clamped so that the elastic pressure is transferred to it by way of the lugs and its position is fixed. The inner ring 25 has a rim 36 which fits around the ring 9 of the camera tube. Owing to the comparatively large deflection distance the relative angular orientation of the two windows can be adjusted whilst the latter are clear of one another. Only after the angular orientation has been correctly adjusted are the windows allowed to be urged into elastic contact. It is of particular advantage that the bulky and heavy coil unit is mounted afterwards. Thus damage may readily be prevented, as may the lodging of dust particles between the windows. Adjustment may simply be performed by using marked fibre-optics plates as described in our co-pending application Ser. No. 484,078, filed June 28, 1974. Such a fibre-optics plate has an adjusting mark 32 which is incorporated in it during manufature. At least one of the fiber-optic plates to be coupled can have, at the coupling surface thereof, a difference in height between the fiber cores 34 and the coatings 36 to form a recess 38, such that, during the coupling operation, a liquid 40 having a refractive index matching the material at the recess, can be added.

In practice television camera tubes usually contain a target electrode which preferably at the surface facing the window has an externally accessible electric terminal. In a preferred embodiment the inner ring 25 is formed with an opening 27 in the sleeve-like part which encloses the window, and a spring contact, not shown, is provided on the inner surface of this sleeve with the result that when the diaphragm construction is mounted in position the electric contact to the target electrode is also provided.

The diaphragm construction may similarly be used for coupling, for example, a window of an electron microscope with a camera tube or with an image amplifier tube. The latter combination may be used to optically intensify a faint image produced for example by a field-emission microscope before studying or recording such an image.

What is claimed is:

1. An image sensing system in which an image-forming apparatus is coupled with a sensing apparatus, comprising said sensing apparatus having an optical window, said image forming apparatus having an optical window that is optically coupled with said optical window of said sensing apparatus, and a diaphragm member disposed at said windows and so coupling said windows by elastic pressure.

2. An image sensing system as in claim 1, wherein said exit window of the image-forming apparatus comprises a fiber optic exit window forming said optical window thereof and said sensing apparatus comprises a fiber optic entrance window comprising said fiber optic window thereof both are fiber optic plates.

3. An image sensing system as in claim 1, wherein said diaphragm is generally rotation-symmetrical and has a central opening, said sensing apparatus further comprising an engagement face for securing the edge thereof at said central opening and said image-forming apparatus comprising means for securing the outer edge of said diaphragm.

4. An image sensing system as in claim 2, wherein at least one of said coupled fiber-optic windows comprises fiber cores and coatings and is characterized by a difference in height at the coupling surface between said fiber cores and coating to form a recess said system further comprising a liquid having a refractive index matching the material of said window at said recess.

5. An image sensing system as in claim 2, wherein said fiber-optic windows comprise respective orientation marks.

6. An image sensing system as in claim 1, wherein said diaphragm is characterized by an elastic pressure of at least about 0.5 kg per $cm^2$ between said coupled windows.

7. An image sensing system as in claim 1, wherein said image-forming apparatus is an X-ray image intensifier and said sensing apparatus is a television camera tube.

8. An image sensing system as in claim 1, wherein said sensing apparatus is a television camera tube and comprises a coil unit surrounding said tube, said coil being attached to said camera tube without bearing on it and being mountable independent of said window coupling.

9. An image sensing system as in claim 1, wherein said window of said sensing apparatus comprises the entrance optical system of a television camera tube.

* * * * *